United States Patent [19]

Pöll

[11] Patent Number: 4,972,685

[45] Date of Patent: Nov. 27, 1990

[54] MOUNT FOR GEMS

[75] Inventor: Martin Pöll, Fritzens, Austria

[73] Assignee: D. Swarovski & Co., Wattens, Austria

[21] Appl. No.: 363,254

[22] Filed: Jun. 7, 1989

[30] Foreign Application Priority Data

Jun. 14, 1988 [DE] Fed. Rep. of Germany ..... 3820249

[51] Int. Cl.[5] ..... A44C 17/02

[52] U.S. Cl. ..... 63/26; 63/28; 63/29.1

[58] Field of Search ..... 63/29.1, 26, 27

[56] References Cited

U.S. PATENT DOCUMENTS

| | | | |
|---|---|---|---|
| 1,079,924 | 11/1913 | Schuetz | 63/26 |
| 1,182,534 | 5/1916 | Driggott | 63/29.1 |
| 1,383,146 | 6/1921 | Perrin | 63/29.1 |
| 2,003,950 | 6/1935 | Pejchar . | |
| 2,069,598 | 2/1937 | Arpels | 63/29.1 |
| 2,510,774 | 6/1950 | Engel . | |
| 2,763,140 | 9/1956 | Lutrario . | |
| 2,852,923 | 9/1958 | Gamelsky . | |

FOREIGN PATENT DOCUMENTS

| | | | |
|---|---|---|---|
| 2247790 | 4/1973 | Fed. Rep. of Germany . | |
| 3342021 | 5/1985 | Fed. Rep. of Germany . | |
| 3510200 | 9/1986 | Fed. Rep. of Germany . | |
| 8618939 | 12/1986 | Fed. Rep. of Germany . | |
| 2080224 | 11/1971 | France . | |
| 491074 | 8/1938 | United Kingdom | 63/27 |
| 826492 | 1/1960 | United Kingdom | 63/26 |

*Primary Examiner*—James R. Brittain

*Attorney, Agent, or Firm*—James R. Haller; Gregory P. Kaihoi; Mary P. Bauman

[57] ABSTRACT

An easily produced, reliable mount for gems comprising a band (21, 22) embracing the periphery of the setting side of the gem (18), said band having a slit (15). At the upper edge of the band (21, 22), holding elements (19, 20) are disposed for the gem (18). Holding tongues (12, 13) disposed on the band (21, 22) and inclined outwardly and upwardly, serve to fix the mount in a carrier opening.

6 Claims, 4 Drawing Sheets

MOUNT FOR GEMS

The present invention relates to a mount for gems, which comprises a ring embracing the periphery of the setting side of the gem and adapted to be pushed into an opening in a carrier and fixed therein, said ring being provided on the edge with holding elements for the gem and having at least one slit adapted to be reduced in size to form a firm mount.

The known prefabricated gem mounts comprise a metal base, the so-called "kettle", which is provided with claws or a border for holding the gem. To mount the gem, one must do screwing as well as soldering, riveting or similar work. The known prefabricated gem mounts are therefore very elaborate in particular for glass stones.

A gem of the species stated in the preamble of claim 1 is known from German utility model No. 86 18 939. A holding ring is provided for mounting the known gem, said ring having an inner walling in the shape of a truncated cone. In the upper area of the inner walling the ring has detents which point inwardly in wedgelike fashion, their straight inner edges engaging corresponding slits worked into the gem. To allow for the gem to be pushed into the detents, radial slits are provided in the upper part of the ring which give the ring inherent elasticity. With the known gem, the ring is fixed in the carrier with an O-ring which is disposed in an annular groove on the outside of the ring and engages an annular groove provided in the carrier.

The known gem mount is too elaborate in particular for glass stones. Such a holding ring provided with detents, a conical contact surface, an annular groove and the like and having a complicated cross-sectional form can only be produced by elaborate methods, such as injection molding. Furthermore, the assembly of the gem with the known mount requires additional slits to be worked into the gem for engaging the detents, and an annular groove to be worked into the carrier for assembling the holding ring in the carrier.

The invention is therefore based above all on the problem of providing a gem mount that can be produced with little effort and allows for a fast, reliable and clean assembly of the gem without any additional working of the carrier opening.

This is achieved according to the invention by a gem mount of the type stated at the outset wherein the ring is formed as a band, the holding elements extend upwardly from the upper edge of the band and embrace the edge of the gem, and the band has outwardly and upwardly bent holding tongues to fix it in the carrier opening, whereby the band, the holding elements extending from the upper edge of the band and embracing the gem, and the holding tongues bent out of the band are formed by being punched out of a metal band, and the slit can be reduced in size to form the firm mount upon insertion of the mount into the carrier opening.

The invention is based on the finding that this problem can be solved by a mount which is placed loosely about the gem, the firm hold of the gem in the mount and of the mount in a bore coming about only when the gem with the mount is introduced into the bore.

According to the invention, one starts with a metal band to produce the mount. For this purpose, a band is punched and bent in such a way as to embrace the periphery of the setting side of the gem, the punched out band being provided with holding elements extending from its upper edge, on the one hand, and holding tongues extending outwardly and upwardly being bent from said band, on the other hand. It is thus relatively easy to produce the inventive mount. The metal used may be in particular brass, tombac or galvanized steel.

In the present application the term "gem" is used in a general way. It includes all kinds of material, in particular glass, also colored glass, but also, for example, glass elements in other uses, such as luster stones or decoration stones. Here, however, "gem" refers in particular to faceted glass elements.

The slit in the band of the inventive mount is necessary for compensating tolerances. Tolerances occur, on the one hand, in the gem, whose diameter should be 1 to 2 mm smaller than the inside diameter of the band, and, on the other hand, in the carrier opening into which the inventively mounted gem is to be inserted. The mount is merely pushed into the blind hole or a through hole produced e.g. by punching, and is thus fixed. The width of the slit or slits of the inventive mount is dimensioned such that when the mount with the gem is introduced into the carrier opening the slit or slits can be reduced in size to form a firm mount.

The holding elements embracing the gem in the inventive mount prevent the gem from sliding out, not only in the case of the finished mount assembled in the hole but even during assembly, i.e. they form a temporary mount for the gem.

According to the invention, the holding tongues are inclined outwardly and upwardly. This presses the holding tongues resiliently against the side wall of the hole into which the mount has been pushed. The holding tongues simultaneously exert pressure inwardly on the gem, and thus serve to fix the gem in the mount.

The holding tongues prevent the kettle from sliding out. On the other hand, they do not impede an easy insertion. To increase the blocking effect and prevent the mount from sliding out of the hole, the tongues are preferably tapered at their ends.

The carrier for receiving the inventively mounted gems may be e.g. a metal band, a cast part, a plastic part or the like. The article to be decorated with the inventively mounted gems may be any article of daily use.

If necessary, the inventive mounting may additionally be fixed to the article in question, e.g. by adhesive. One requires very little adhesive for this, so that a clean bond is ensured.

The holding elements of the inventive mount extend upwardly from the upper edge of the band, i.e. from the edge facing away from the setting side of the gem. This may be, for example, a web embracing the edge of the gem, or a plurality of claws embracing the edge of the gem. The number of claws can be selected at will, but should be at least three. Due to the high strength of the inventive mount, relatively few and relatively small claws can be provided. If the claws are provided at their ends with small plates or paws, the inventive mount acquires an appealing shape similar to a crown.

The diameter of the gems at their equator is preferably greater than the diameter of the mount and the hole. This makes it possible to set the gems very close together, so that the surface is fully covered by gems but there are still enough webs between the holes to allow for reliable fixing, and the strength of the carrier is retained.

In the following, the invention shall be explained in more detail with reference to the drawing, in which FIG. 1 shows a top view of a part for making a first embodiment of the inventive mount;

Figure 1:
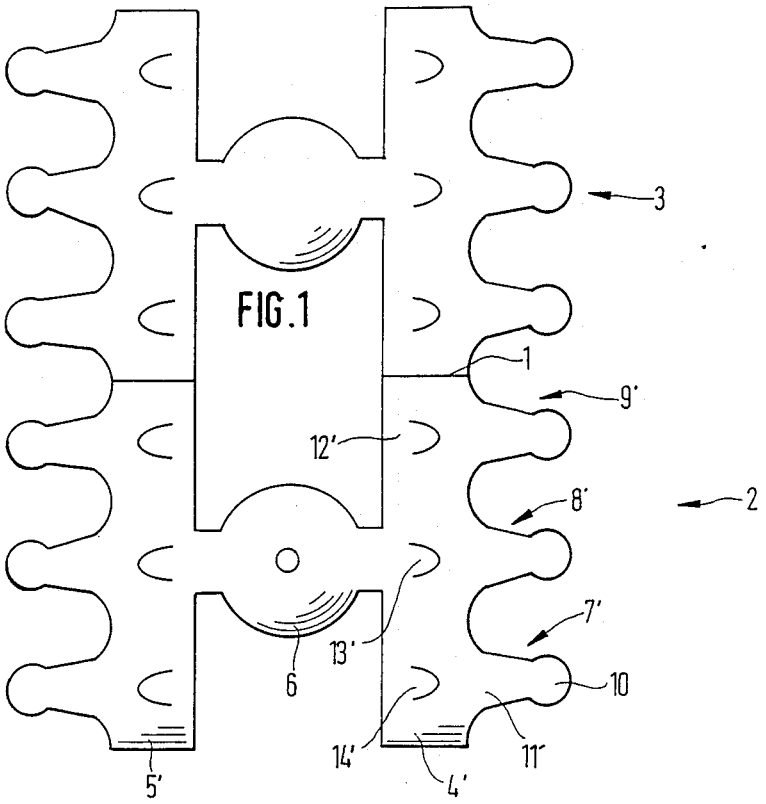

According to FIG. 1, two parts 2, 3 are punched out of a band material, and can be separated from each other at point of separation 1. One gem mount can be made from each part 2, 3.

Each part 2, 3 comprises, as illustrated for part 2, two band portions 4' and 5', each of which will form one half of the mount. The two portions 4' and 5' are interconnected by a bottom web 6.

Each portion 4', 5' has, as illustrated for part 4', three claw portions 7', 8' and 9' which comprises, as illustrated for claw portion 7', a small plate 10 at the free end and a web portion 11' which connects plate 10 with band portion 4'.

Three holding tongue portions 12', 13' and 14' are also punched into each band portion 4', 5', as illustrated for band portion 4'.

Figure 2:
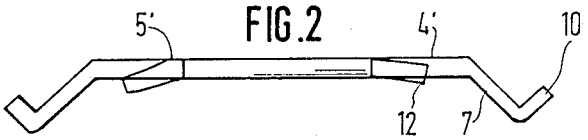
FIG. 2 shows a side view of the part after the bending of the claws and the holding tongues.

According to FIG. 2, holding tongue portion 12' (and the other portions 13' and 14' not shown in FIG. 2) is bent to form outwardly inclined holding tongue 12 after parts 2 and 3 are punched out. Claw portion 7' (and the other portions 8' and 9' not shown in FIG. 2) is also bent outwardly to form claw 7 and bent inwardly with plate 10.

Figure 3:
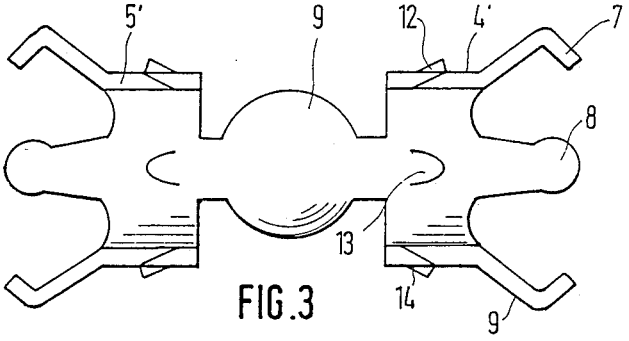
FIG. 3 shows a top view of the part after the bending of the part to form the two halves of the mount.

According to FIG. 3, each portion 4', 5' is then bent together to form a semicylindrical dish. Semicylidrically bent portions 4', 5' are thereafter bent at right angles at their lower edge at which they are connected to bottom web 6 so that the two semicylindrical dish-shaped portions 4, 5 yield a mount as in FIG. 4, in which each band portion 4, 5 forms one half of the mount.

It is evident that two band portions 4, 5 form together a band which embraces the periphery of the setting side of the gem (not shown). The two band portions 4, 5 are separated by two slits, whereby only one slit 15 is visible in FIG. 4. Holding tongues 12, 13 (and holding tongue 14 not shown) are inclined outwardly and upwardly. Claws 7, 8 (and claw 9 not shown) which extend upwardly from the upper edge of band 4, 5, i.e. from the edge facing away from the setting side of the gem, constitute the holding elements for the gem.

Figure 4:
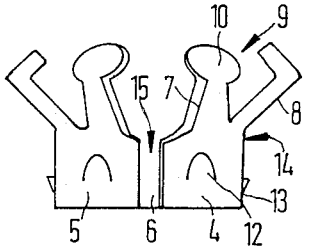
FIG. 4 shows a side view of the first embodiment of the inventive mount obtained according to FIGS. 1 to 3.
Figure 6:
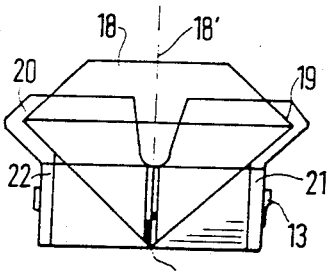
FIGS. 6 and 7 show a side view and a top view, respectively, of the second embodiment of the inventive mount.
Figure 7:
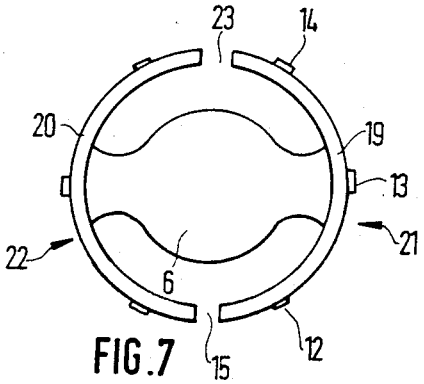

The embodiment of FIGS. 6 and 7 differs from that of FIG. 4 essentially in that the holding element is formed as a web comprising the two web parts 19, 20 on band portion 21, 22. Web parts 19, 20 extend upwardly, as in the embodiment of FIG. 4, from the upper edge of the two band portions 21, 22.

Figure 5:
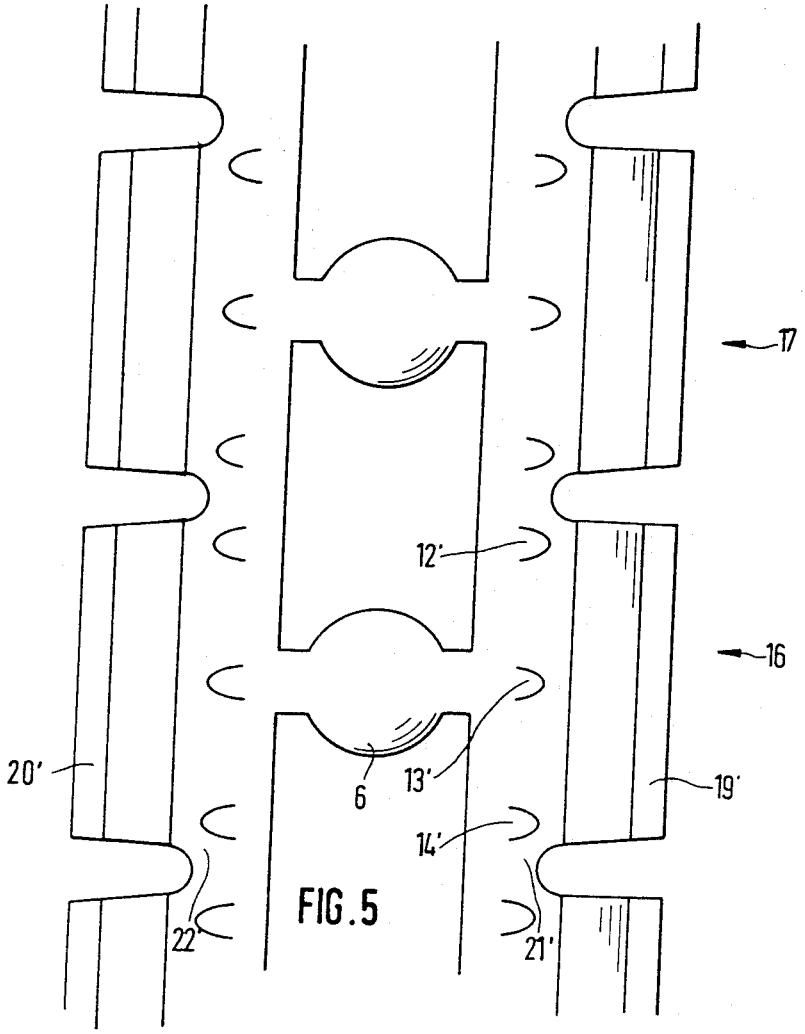
FIG. 5 shows a top view of a part for making a second embodiment of the inventive mount.

Accordingly, each punched part 16, 17, from which the mount as in FIGS. 6 and 7 is made, comprises, as shown in FIG. 5, a band portion 21', 22' connected by a bottom web 6 and each having a web part portion 19', 20' disposed thereon. In this embodiment, the edge of gem 18 is thus bordered by web parts 19, 20, and two slits 15, 23 extending parallel to center axis 18' of the gem are provided, as in the embodiment of FIG. 4.

Figure 9:
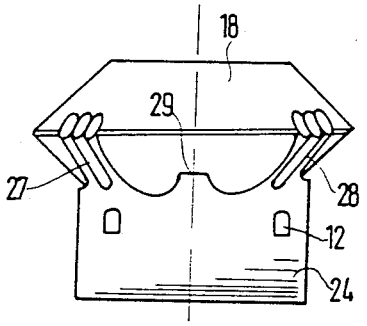
FIG. 9 shows a side view of the third embodiment of the inventive mount.

In the embodiment of FIG. 9, the mount is made from one band portion 24', the individual band portions 24' being held together after punching by webs 25.

Band 24' separated from web 25 is bent to form a cylindrical band 24 that yields the mount (FIG. 9).

In contrast to the embodiments described above, supporting webs 29 extend upwardly in this embodiment from the upper edge of band 24 between each pair of claws 27, 28, supporting webs 29 engaging the underside of gem 18.

Figure 8:
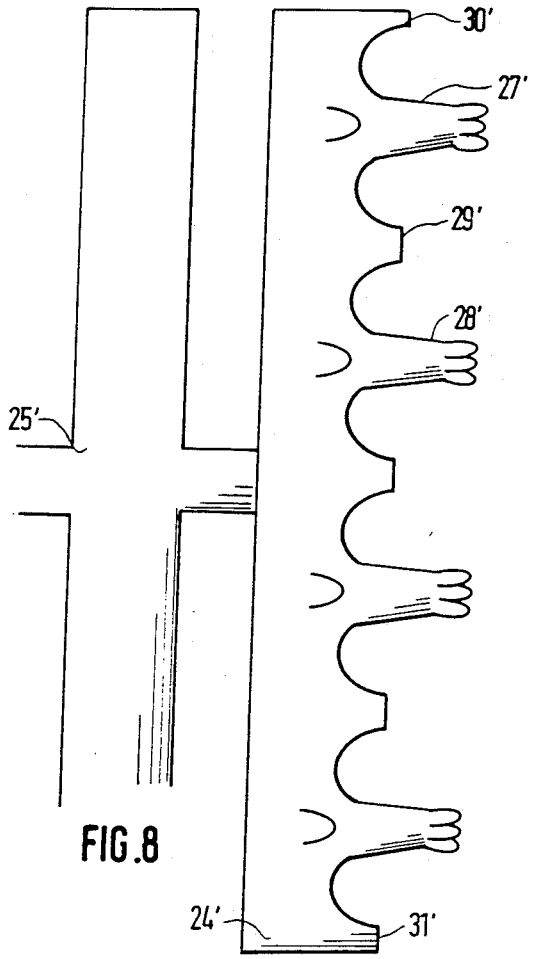
FIG. 8 shows a top view of a part for making a third embodiment of the inventive embodiment.

The punched part of FIG. 8 accordingly has portions 27', 28', altogether four of them, and portions 29, altogether three of them, from which claws 27, 28 and supporting webs 29 are formed, respectively. A further supporting web is formed from the two portions 30' and 31' on the two ends of band 24, with the slit in band 24 therebetween (not shown in FIG. 9).

Figure 10:
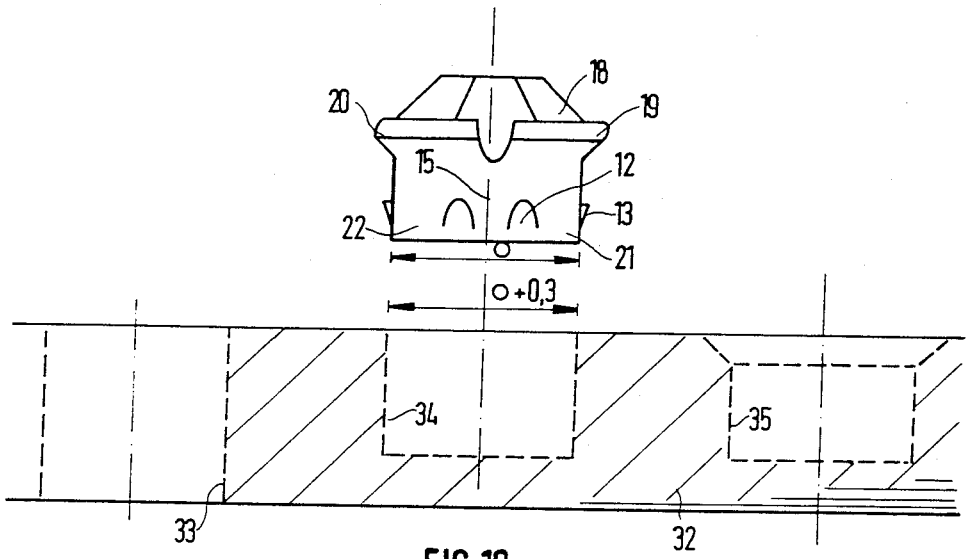
FIG. 10 shows examples of assembly for an inventively mounted gem.

FIG. 10 shows three examples of assembly for a gem 18 as in FIG. 6. A carrier 32 is provided which has a punched or bored through hole 33 and with two blind holes 34 and 35, blind hole 35 being beveled in a conical shape on the upper edge so that the edge of gem 18 is flush with the upper side of carrier 32.

I claim:

1. A mount for a gem which comprises a ring for embracing the periphery of the setting side of the gem and being adapted to be pushed into an opening in a carrier to become fixed therein, said ring being provided with holding elements for the gem and having at least one slit in the ring extending through the entire axial length of the ring adapted to allow the ring to be resiliently reduced in size to form a firm mount, characterized in that the ring is formed as a band, the holding elements extend upwardly from the upper edge of the band and embrace over the edge of the gem, and the band has outwardly and upwardly bent resilient holding tongues for engaging the carrier opening, whereby the band, the holding elements extending from the upper edge of the band and embracing the gem, and the holding tonges bent out of the band are formed by being punched out of a metal band, and the width of the slit in the ring can be resiliently reduced in size to form the firm mount upon insertion of the mount into the carrier opening.

2. The mount of claim 1, wherein the gem has a generally vertical center axis and the slit extends generally parallel to the gem's center axis.

3. The mount of claim 1 or 2, characterized in that the holding elements are formed as a web extending upwardly from the upper edge of the band and embracing the edge of the gem.

4. The mount of claim 1, characterized in that the holding elements are formed as a plurality of claws extending upwardly from the upper edge of the band and embracing the edge of the gem.

5. The mount of claim 4, characterized in that supporting webs extending upwardly from the upper edge of the band and adapted to engage the underside of the gem are provided between the claws, said supporting webs being shorter than the claws.

6. The mount of claim 1, characterized in that the band comprises two separate portions each forming one half of the mount and being interconnected at their lower edges by a bottom web.

* * * * *